US007469495B2

(12) United States Patent
Konieczny et al.

(10) Patent No.: US 7,469,495 B2
(45) Date of Patent: Dec. 30, 2008

(54) FOLDING DISPLAY APPARATUS

(75) Inventors: Robin Konieczny, Charlotte, NC (US); Al Christensen, Charlotte, NC (US)

(73) Assignee: Clear Blue, Inc., Davidson, NC (US)

( * ) Notice: Subject to any disclaimer, the term of this patent is extended or adjusted under 35 U.S.C. 154(b) by 154 days.

(21) Appl. No.: 11/163,174

(22) Filed: Oct. 7, 2005

(65) Prior Publication Data

US 2006/0088359 A1 Apr. 27, 2006

Related U.S. Application Data

(60) Provisional application No. 60/617,118, filed on Oct. 8, 2004.

(51) Int. Cl.
*G09F 7/00* (2006.01)

(52) U.S. Cl. ..... 40/605; 273/155; 40/493; 446/124; 446/147; 472/57; 472/71; 472/73; 472/77

(58) Field of Classification Search ..... 273/155; 40/493, 605; 446/124, 147; 472/57, 71, 472/73, 77

See application file for complete search history.

(56) References Cited

U.S. PATENT DOCUMENTS 239,879 A * 4/1881 Stranders ..... 273/157 R
2,307,528 A * 1/1943 Massey ..... 472/71
2,883,195 A * 4/1959 Rogers et al. ..... 273/155
4,302,897 A * 12/1981 Deckys ..... 40/605
4,323,244 A * 4/1982 Busing ..... 273/155
4,633,607 A * 1/1987 Brasch et al. ..... 40/530
5,192,077 A * 3/1993 Caicedo ..... 273/155
5,299,804 A * 4/1994 Stevens ..... 273/155
5,628,670 A * 5/1997 Hill ..... 446/487
6,386,541 B1 * 5/2002 Cornelius et al. ..... 273/155

* cited by examiner

*Primary Examiner*—Paul N Dickson
*Assistant Examiner*—Shin Kim
(74) *Attorney, Agent, or Firm*—Adams Intellectual Property Law, P.A.

(57) ABSTRACT

A folding display apparatus includes: first and second forms; and at least one flexible connector strip interconnecting the first and second forms and carrying indicia thereon in a pre-selected pattern. The apparatus is moveable between a first position in which the first and second forms collectively define a face bearing a first image composed from the indicia; and a second position in which the first and second forms collectively define a second face bearing a second image composed from the indicia.

10 Claims, 6 Drawing Sheets

FOLDING DISPLAY APPARATUS

CROSS-REFERENCE TO RELATED APPLICATIONS

This application claims the benefit of U.S. Provisional Application Ser. No. 60/617,118 Filed Oct. 8, 2004.

BACKGROUND OF THE INVENTION

This invention relates generally to advertising or amusement devices and more particularly to a folding display apparatus for carrying advertisements thereon.

It is known to incorporate advertising in many different types of media such as print, sound, and video. Advertising is also often incorporated into common objects, such as pens and office supplies, that can be sold at low cost or provided gratis to a client. In addition to these known methods it is desirable to present advertising or information in a way which will attract a consumer's attention through a unique appearance, and encourage the consumer to interact with the object and to observe the advertising or information contained thereon for an extended period of time.

Accordingly, there is a need for a display apparatus which is inexpensive and catches a consumer's attention.

BRIEF SUMMARY OF THE INVENTION

The above-mentioned need is met by the present invention, which according to one embodiment provides a folding display apparatus, including: first and second forms each having a plurality of faces; and at least one flexible connector strip interconnecting the first and second forms and carrying indicia thereon in a preselected pattern The apparatus is moveable between: a first position in which a first pair of faces of the first and second forms collectively display a first selected image composed from the indicia; and a second position in which a second pair of faces of the first and second forms collectively display a second selected image composed from the indicia.

According to another embodiment of the invention, the apparatus is moveable to additional positions in which additional selected images are displayed.

According to another embodiment of the invention, the display apparatus includes a plurality of connector strips arranged in a side-by-side relationship, wherein the indicia carried by the individual connector strips collectively form the first and second images.

According to another embodiment of the invention, alternate ones of the connector strips are wrapped in opposite directions around the first and second forms.

According to another embodiment of the invention, the alternate wrapping of the connector strips forms a hinge-like connection that allows the first and second forms to pivot relative to each other, such that a pivoting motion of the first and second forms causes one of the connector strips to wind more fully around the first form, while another of the connector strips unwinds from the first form.

According to another embodiment of the invention, each of the connector strips is divided into individual segments, and the indicia representing portions of the images are carried on the connector strip in a pattern which accommodates the direction the connector strip would onto the form.

According to another embodiment of the invention, the first and second forms are prismatic.

According to another embodiment of the invention, each of the first and second forms is a rectangular solid.

According to another embodiment of the invention, the connector strip is made from paper.

According to another embodiment of the invention, the connector strip is made from plastic According to another embodiment of the invention, the first and second forms are hollow boxes.

According to another embodiment of the invention, the indicia are selected from the group consisting of: information, text, symbols, colors, patterns, photographs, and combinations thereof.

According to another embodiment of the invention, a method of displaying a series of preselected images includes: providing a folding display apparatus, including: first and second forms each having a plurality of faces; and at least one flexible connector strip interconnecting the first and second forms and carrying indicia thereon in a preselected pattern; pivoting the first and second forms to move the apparatus to a first position in which a first pair of faces of the first and second forms collectively display a first selected image composed from the indicia; and pivoting the first and second forms to a second position in which a second pair of faces of the first and second forms collectively display a second selected image composed from the indicia.

According to another embodiment of the invention, the method of claim 13 further includes pivoting the first and second forms to an additional position in which an additional pair of faces of the first and second forms collectively display an additional selected image composed from the indicia

BRIEF DESCRIPTION OF THE DRAWINGS

The subject matter that is regarded as the invention may be best understood by reference to the following description taken in conjunction with the accompanying drawing figures in which.

DETAILED DESCRIPTION OF THE INVENTION

Figure 1:
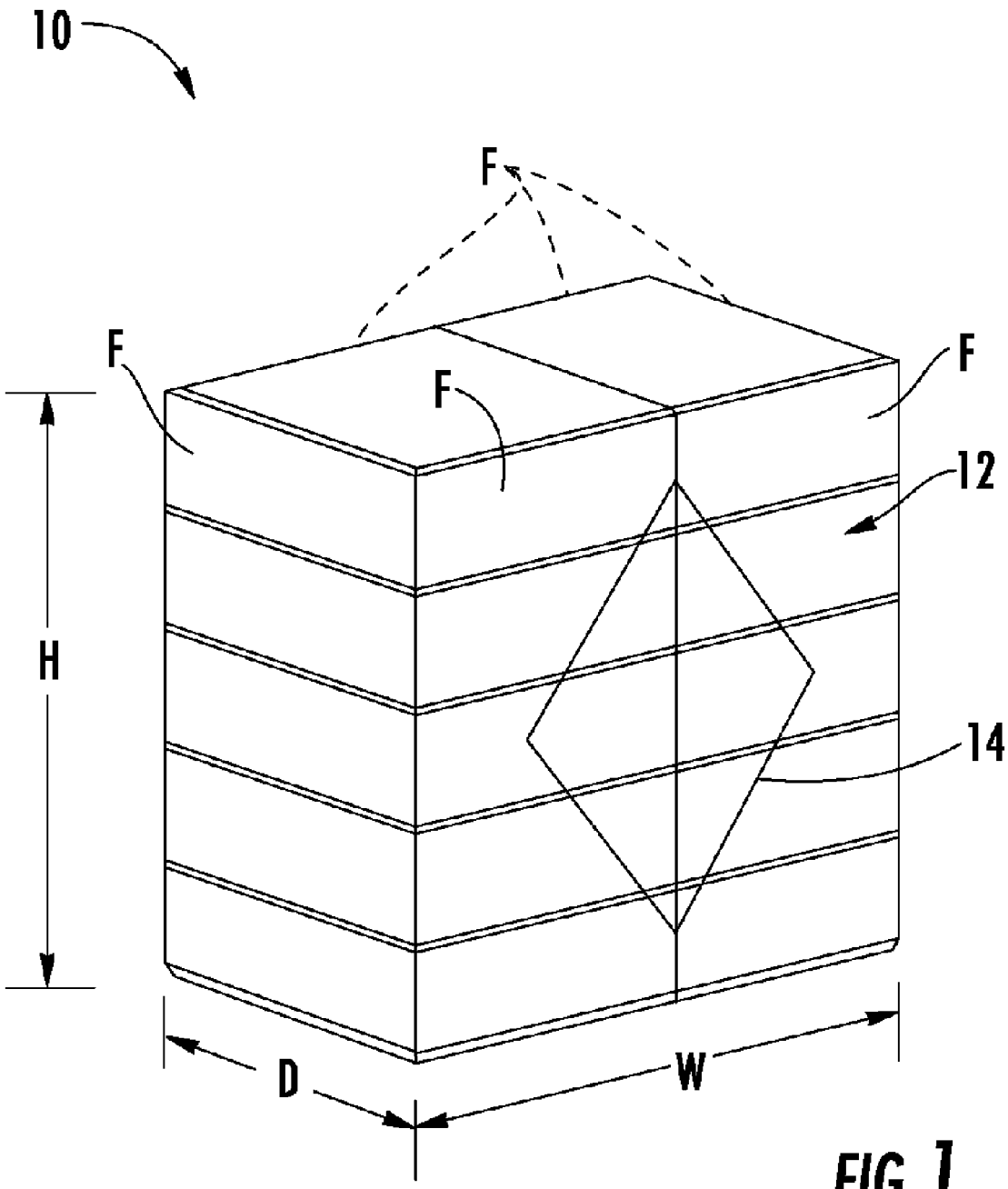
FIG. 1 is a perspective view of a folding display apparatus constructed in accordance with the present invention and arranged in a first position.

Referring to the drawings wherein identical reference numerals denote the same elements throughout the various views, FIG. 1 illustrates an exemplary folding display apparatus 10 constructed in accordance with the present invention. In the illustrated example, the display apparatus 10 has a height "H" of about 12.7 cm (5 in.), a width "W" of about 25.4 cm (10 in.), and a depth "D" of about 12.7 cm (2.5 in.) The display apparatus 10 may be scaled up or down as desired. The display apparatus 10 includes a number of external faces "F", two of which are positioned to define a generally planar front face 12 which presents indicia such as information, text, symbols, colors, patterns, photographs, or a combination thereof to a user. Representative indicia 14 is illustrated in FIG. 1.

Figure 2:
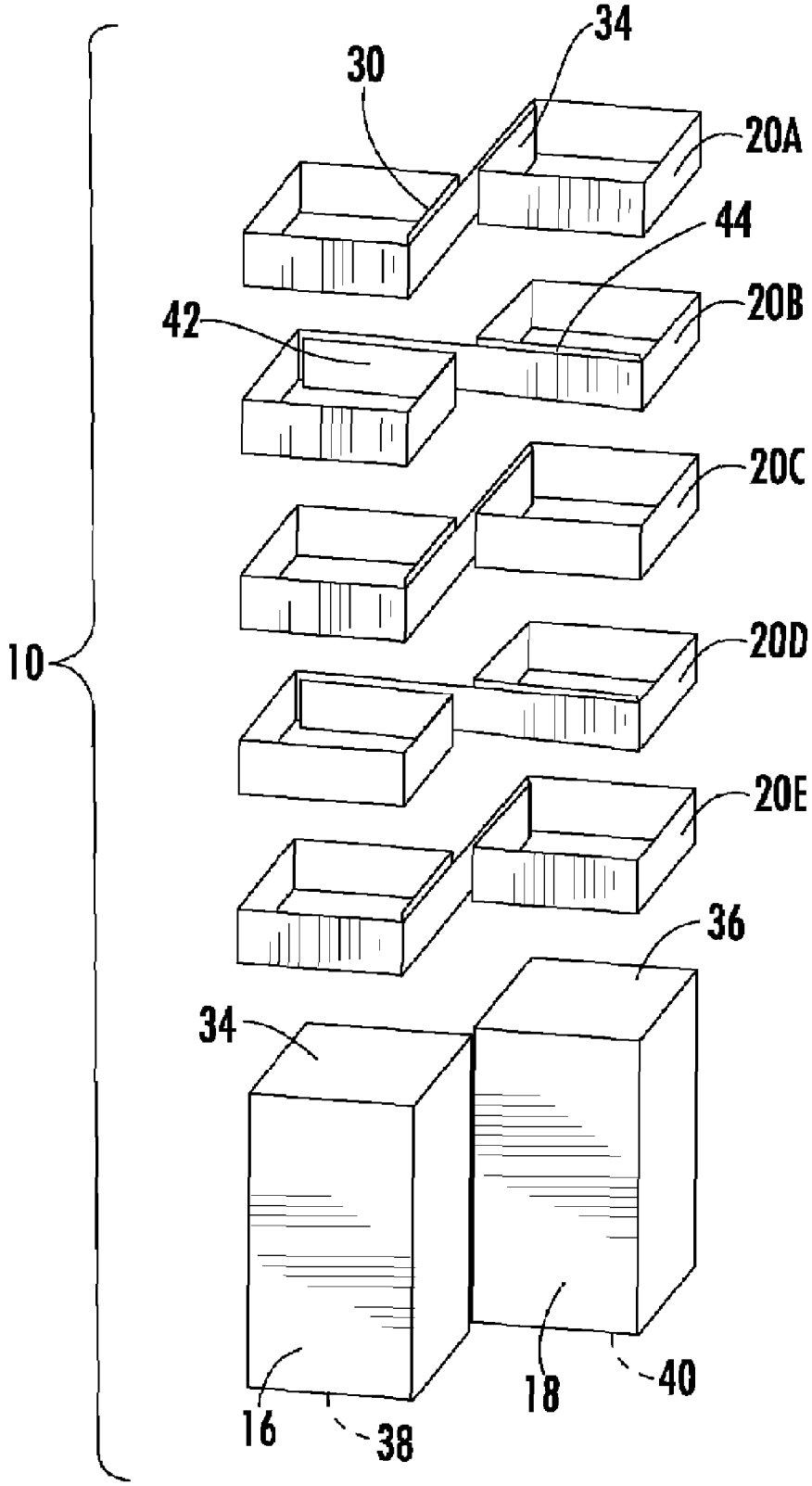
FIG. 2 is a exploded perspective view of a folding display apparatus constructed according to the present invention, showing the component parts thereof.

As shown in FIG. 2, the basic components of the display apparatus 10 are a pair of first and second forms 16 and 18 and one or more connector strips 20. In the illustrated example, five side-by-side connector strips 20A-20E are used. The number of connector strips 20 may be varied to suit a particular application. Alternate ones of the connector strips 20A-20E are wound around the first and second forms 16, 18 in opposite directions, as explained more fully below.

Figure 3A:
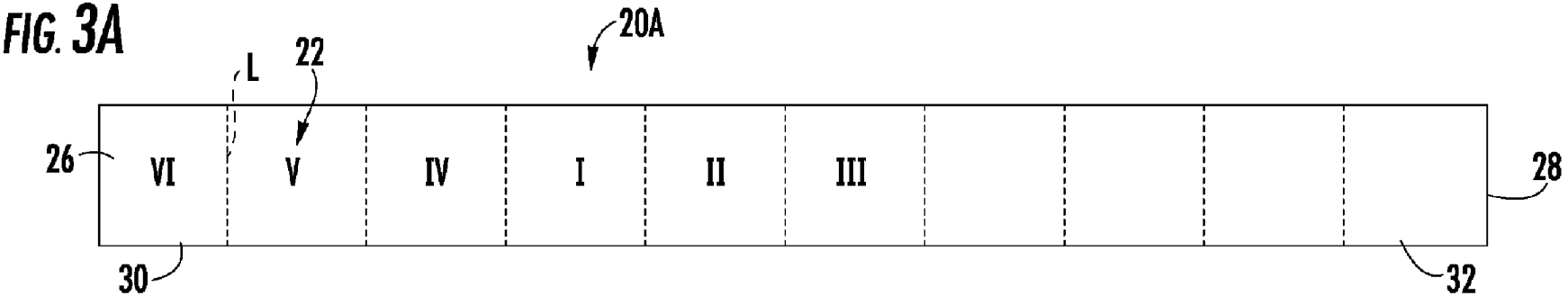
FIG. 3A is a view of a first side of a connector strip for use with the present invention.
Figure 3B:
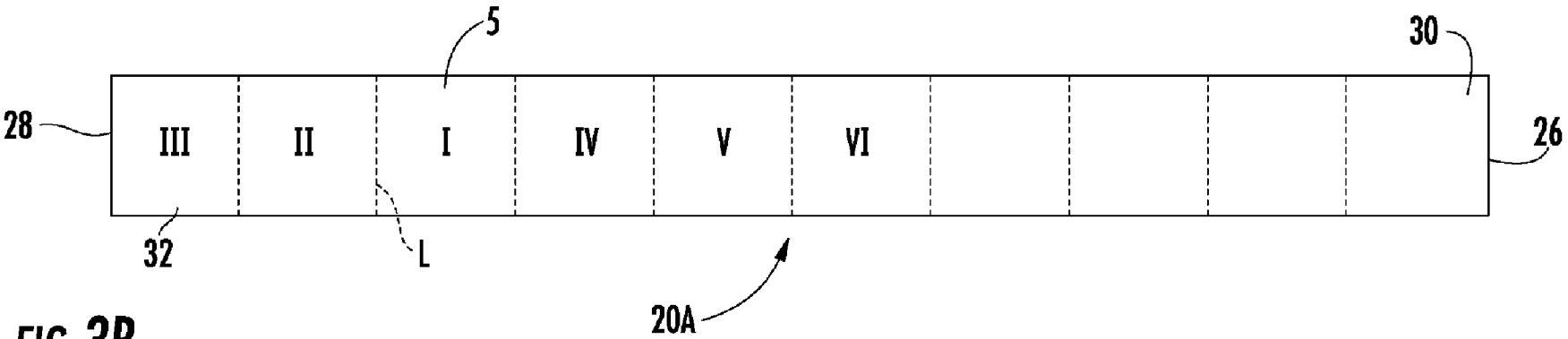
FIG. 3B is a view of a second side of a connector strip for use with the present invention.

FIGS. 3A and 3B illustrate opposite sides of a connector strip 20A, which is representative of the other connector strips 20B-20E, in more detail. The connector strip 20A may be constructed of any relatively thin, flexible material capable of displaying indicia such as information, text, symbols, colors, patterns, photographs, or a combination thereof. Examples of suitable materials include paper and related fiber products, fabrics, and plastic sheet materials. The connector strip 20A has opposed first and second sides 22 and 24, and opposed first and second ends 26 and 28. The connector strip 20A is divided at fold lines "L" into a series of individual segments, generally denoted "S" The segments S closest to the first and second ends 26 and 28 are denoted as first and second end segments 30 and 32, respectively.

The segments S of the connector strip 20A bear indicia which are arranged so as to present desired patterns when the connector strip 20A is wrapped around the first and second forms 16 and 18. This may mean that the indicia are carried on the connector strip 20A in a discontinuous arrangement when viewed in a flat, stretched-out condition. The indicia are illustrated in a schematic manner using Roman numerals in FIGS. 3A and 3B.

The first and second forms 16 and 18 each have a top end 34, 36 and a bottom end 38, 40, respectively. The first and second forms 16 and 18 serve as a structural support for the connector strips 20A-20B. In the illustrated example, the first and second forms 16 and 18 are hollow boxes constructed from light cardboard. Either of the first and second forms 16 and 17 could be used to contain items such as small gifts therein, and may be provided with one or more openings (not shown) to facilitate removal of those items. The first and second forms 16 and 18 could be made from other materials and could be solid if desired. The shape of the first and second forms 16 and 18 may also be varied as desired, so long as they are capable of being positioned to cooperatively define at least one external face.

Referring to FIG. 2, alternate ones of the connector strips 20 are wrapped in the opposite direction around the first and second forms 16 and 18. For example, the uppermost connector strip 20A is wrapped around the first form 16 in a counter-clockwise direction as viewed from the top end 34, beginning with the first end segment 30, which is permanently attached to the first form 16 with adhesive or the like. The uppermost connector strip 20A is also wrapped around the second form 18 in a counter-clockwise direction as viewed from the top end 36, beginning with the second end segment 32, which is permanently attached to the second form 18 with adhesive or the like.

The adjacent connector strip 20B is wrapped around the first form 16 in a clockwise direction as viewed from the top end 34, beginning with its first end segment 40. The connector strip 20B is wrapped around the second form 18 in a counter-clockwise direction as viewed from the top end 36, beginning with its second end segment 42, which is permanently attached to the second form 18 with adhesive or the like.

This alternate wrapping arrangement of the connector strips 20A and 20B forms a hinge-like connection "H" that allows the first and second forms 16 and 18 to pivot relative to each other, and creates a condition in which a pivoting motion of the first and second forms 16, 18 causes one of the connector strips 20A to wind more fully around the one of the forms 16 and 18, while the other connector strip 20B "unwinds" from the other one of the forms 16 and 18. While the number of connector strips 20 is optional, it has been found that if at least two connector strips 20 are used, then the forms 16 and 18 will be securely held together and prevented from flexing or moving relative to each other except along the hinge-like connection "H".

Referring again to FIG. 1, the display apparatus 10 presents the front face 12 which is a composite image of the exposed panels of the connector strips 20A-20E, which displays the indicia 14. In the illustrated example, the front face 12 comprises ten exposed segments "S" of the five connector strips 20A-20E arrayed in a top-to-bottom fashion, and the forms 16 and 18 collectively define a generally rectangular solid.

Figure 4:
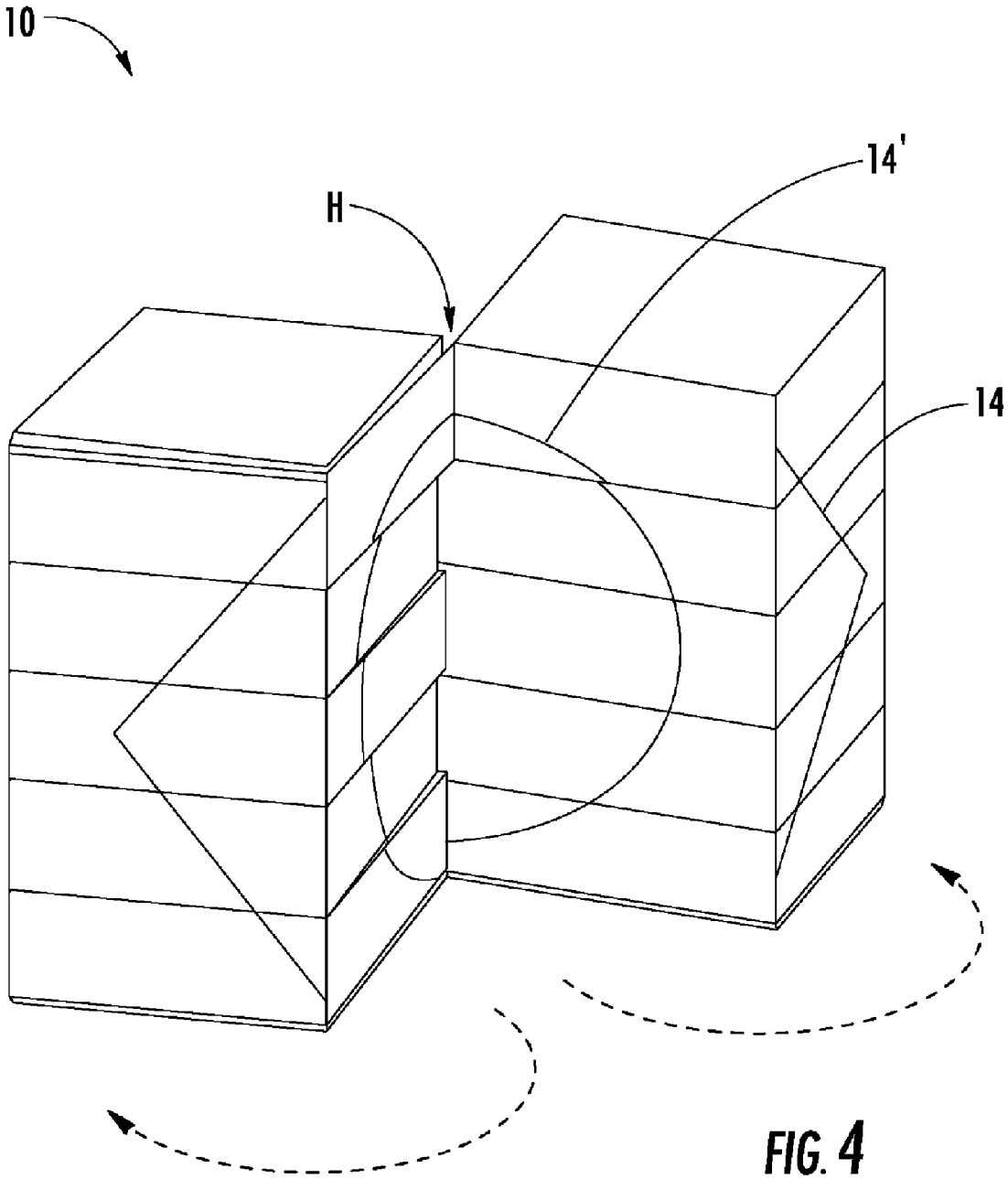
FIG. 4 is a perspective view of the assembled folding display apparatus in an intermediate position.

FIG. 4 shows the display apparatus 10 in a transition position in which the first form 16 has been rotated clockwise a fraction of a turn, and the second form 18 has been rotated counter-clockwise a fraction of a turn. The faces bearing the indicia 14 are now spread apart and the faces bearing a second set of indicia 14' such as information, text, symbols, colors, patterns, photographs, or a combination thereof are partially exposed.

Figure 5:
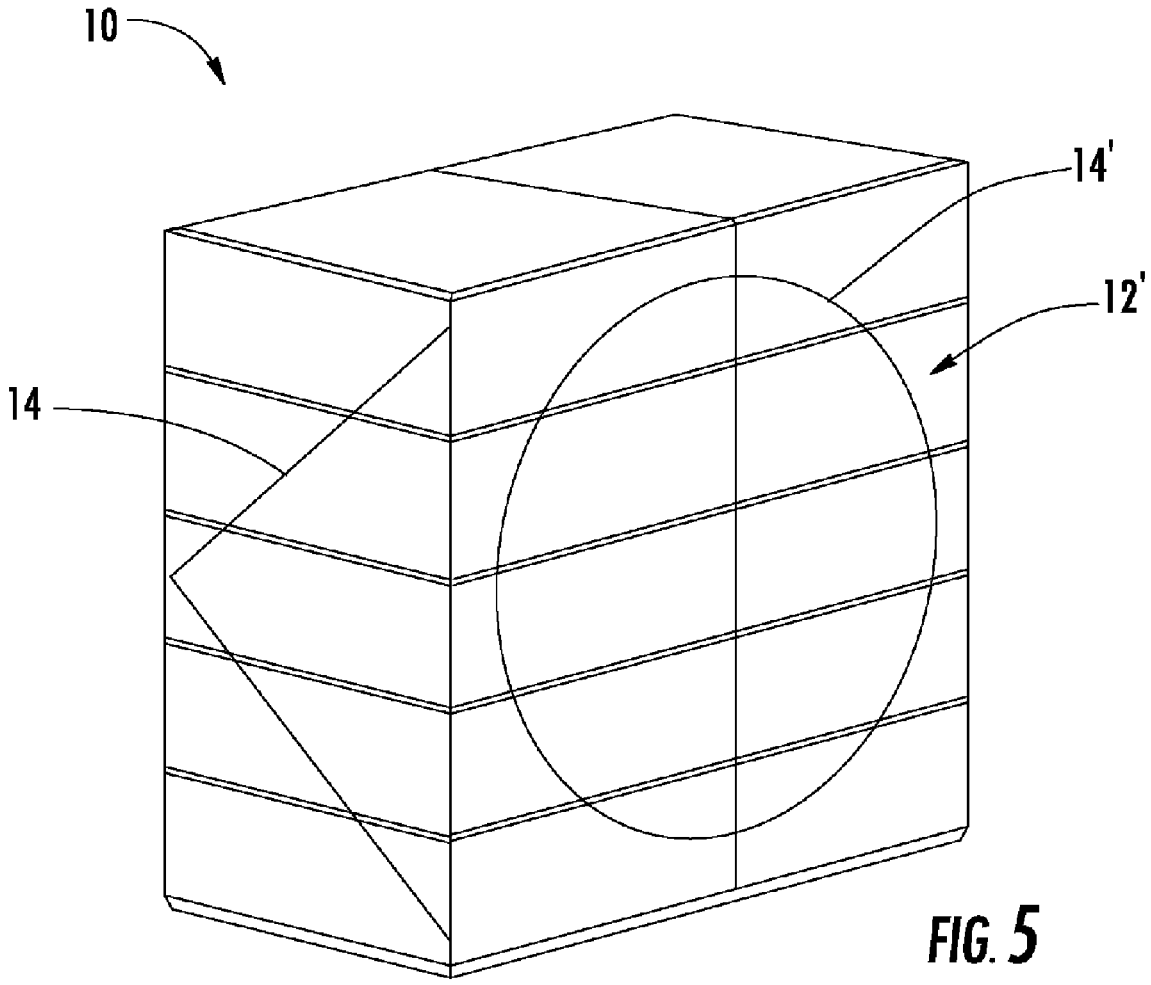
FIG. 5 is a perspective view of the assembled folding display apparatus in a second position.

FIG. 5 shows the display apparatus 10 rotated to a second position. The facets bearing the second set of indicia 14' are now disposed side-by-side so that they constitute a second iteration of a front face 12'.

The display apparatus may continue to be rearranged into additional positions by further rotation of the first and second forms 16 and 18. The greater the length of the connector strips 20A-20E, the greater the total number of faces available. A folding display apparatus has been disclosed. Various details of the invention may be changed without departing from its scope. Furthermore, the foregoing description of the preferred embodiments of the invention and the best mode for practicing the invention are provided for the purpose of illustration only and not for the purpose of limitation.

What is claimed is:

1. A folding display apparatus, comprising:

first and second forms each having a plurality of faces; and a plurality of continuous flexible connector strips arranged in a side-by-side relationship and interconnecting the first and second forms and carrying indicia thereon in a preselected pattern;

wherein the apparatus is moveable between:

a first position in which a first pair of faces of the first and second forms cooperatively form a planar surface to collectively display a first selected image composed from the indicia; and a second position in which a second pair of faces of the first and second forms cooperatively form a planar surface to collectively display a second selected image composed from the indicia; and wherein the indicia carried by the plurality of connector strips collectively form the first and second images; and wherein alternate ones of the connector strips are wrapped in opposite directions around the first and second forms; and wherein the first form is rotated counterclockwise to move it from the first position to the second position, and the second form is rotated clockwise to move it from the first position to the second position.

2. The display apparatus of claim 1 wherein the apparatus is moveable to additional positions in which additional selected images are displayed by rotating the first form clockwise from the first position to a third position, and rotating the second form counterclockwise from the first position to a third position.

3. The display apparatus of claim 1 wherein the alternate wrapping of the connector strips forms a hinge-like connection that allows the first and second forms to pivot relative to each other, such that a pivoting motion of the first and second forms causes one of the connector strips to wind more fully around the first form, while another of the connector strips unwinds from the first form.

4. The display apparatus of claim 3 wherein each of the connector strips is divided into individual segments, and the indicia representing portions of the images are carried on the connector strip in a pattern which accommodates the direction the connector strip is wound onto the form.

5. The display apparatus of claim 1 wherein the first and second forms are prismatic.

6. The display apparatus of claim 1 wherein each of the first and second forms is a rectangular solid.

7. The display apparatus of claim 1 wherein the connector strips comprise paper.

8. The display apparatus of claim 1 wherein the connector strips comprise plastic.

9. The display apparatus of claim 1 wherein the first and second forms are hollow boxes.

10. The display apparatus of claim 1 wherein the indicia are selected from the group consisting of: information, text, symbols, colors, patterns, photographs, and combinations thereof

* * * * *